US005560746A

United States Patent [19]

Willow

[11] Patent Number: 5,560,746

[45] Date of Patent: Oct. 1, 1996

[54] DEVICE FOR MANUAL APPLICATION OF ACUPRESSURE

[76] Inventor: Sky F. Willow, 151 - 10090 152nd Street, Suite #118, Surrey, B.C. V3R 8X8, Canada

[21] Appl. No.: 339,162

[22] Filed: Nov. 10, 1994

Related U.S. Application Data

[63] Continuation-in-part of Ser. No. 35,027, Mar. 22, 1993, abandoned.

[30] Foreign Application Priority Data

Jul. 16, 1992 [CL] Chile ..... 739-92

[51] Int. Cl.[6] ..... A61H 7/00; A61H 15/00; A61H 39/04

[52] U.S. Cl. ..... 601/135; 606/204

[58] Field of Search ..... 600/9; 606/204; 601/15, 18, 73, 78, 81, 134–135, 137

[56] References Cited

U.S. PATENT DOCUMENTS

| | | | |
|---|---|---|---|
| 368,699 | 8/1887 | Zervas | 606/204 |
| 687,363 | 6/1901 | Wirt . | |
| 869,250 | 10/1907 | Martin . | |
| 916,637 | 3/1909 | Wallen | 601/135 |
| 1,354,865 | 10/1922 | Winter | 601/135 |
| 1,612,343 | 6/1925 | Amussen . | |
| 2,127,674 | 7/1938 | Clarke . | |
| 2,168,975 | 6/1939 | Clarke . | |
| 2,180,775 | 11/1939 | Stevens | 601/135 |
| 2,227,276 | 12/1940 | Salit | 601/134 |
| 2,280,274 | 4/1942 | Wildermuth | 601/134 |
| 2,477,666 | 8/1947 | Smallen . | |
| 3,672,355 | 6/1972 | Ogowa et al. | 601/135 |
| 4,091,805 | 3/1977 | Clark . | |
| 4,266,536 | 12/1979 | Casares . | |
| 4,479,495 | 9/1982 | Isaacson . | |
| 4,483,328 | 11/1984 | Wolocko | 601/135 |
| 4,493,315 | 1/1985 | Iwahashi . | |
| 4,520,798 | 6/1985 | Lewis . | |
| 4,574,788 | 3/1986 | Jordan . | |
| 4,608,967 | 9/1986 | Piro . | |
| 4,798,198 | 1/1988 | Wright . | |
| 4,944,747 | 7/1990 | Newth . | |
| 4,974,582 | 12/1990 | Johnson | 601/134 |
| 5,143,057 | 9/1992 | DePasquale | 601/135 |

FOREIGN PATENT DOCUMENTS 2574288 11/1984 France .

OTHER PUBLICATIONS

Dr. Lee Nan Ji Omd, "New Pratical Acupuncture Medicine" New Asia Publishing Corporation, I84–I86, Johnston Rd. Wanchai, Hong Kong Nov. 1980.

Kiiko Matsumoto & Stephen Birch "Extraordinary Vessels" Paradigm Publications 44 Linden St., Brookline Massachusetts 02146–1986.

Yves Requena, M.D. Terrains & Pathology in Acupuncture, vol. one Paradigm Publications, 44 Linden St. Brookline, MA.–1986.

*Primary Examiner*—Gary Jackson
*Assistant Examiner*—Nancy Mulcare

[57] ABSTRACT

A manual device for self-application of acupressure by a user, comprises a substantially "J"-shaped rigid frame having a first tip at one end for application of pressure to specific points of the user's body and a handle at the other end. The first tip is adapted to be placed on the back portions of the user while the frame is substantially transverse to the user's body. The handle is adapted to be grabbed by the user such that a pushing force imparted to the handle away from the user's body transmits pressure to the first tip.

17 Claims, 3 Drawing Sheets

FIG. 4
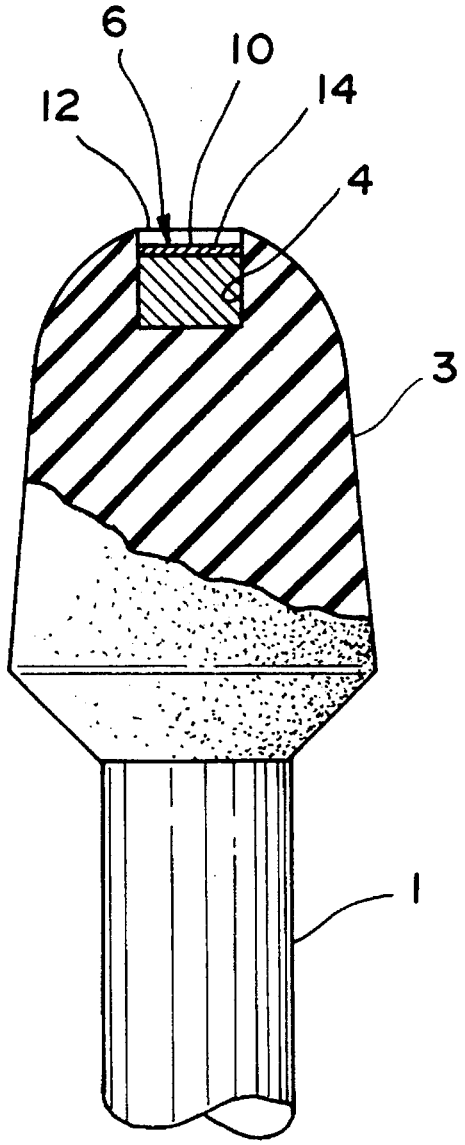
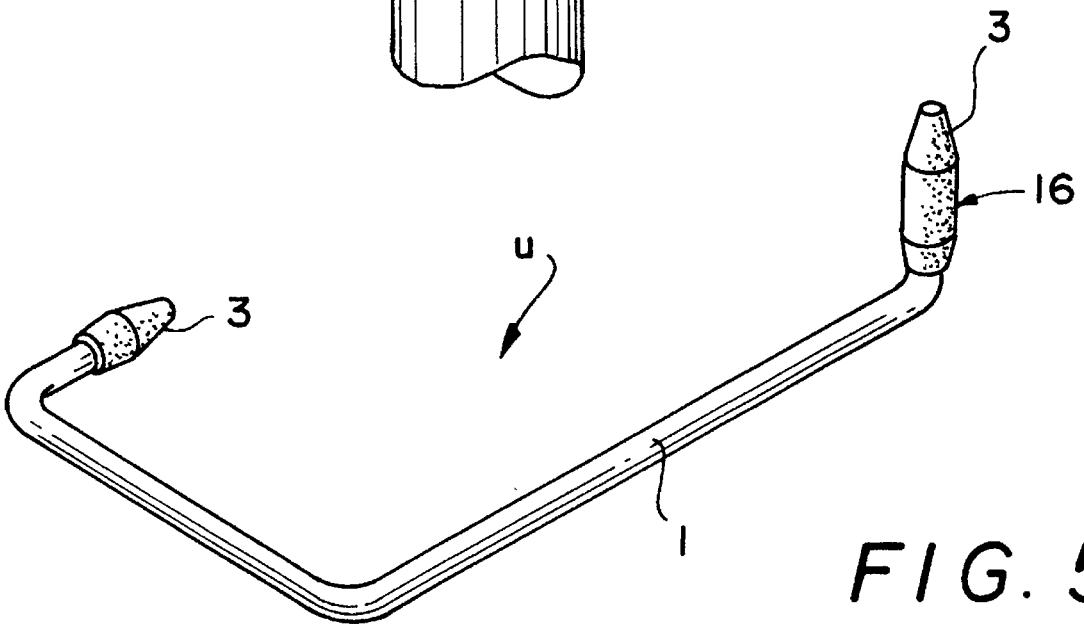
FIG. 5

DEVICE FOR MANUAL APPLICATION OF ACUPRESSURE

RELATED APPLICATIONS

This application is a continuation-in-part of application Ser. No. 08/035,027, filed on Mar. 22, 1993, now abandoned.

FIELD OF THE INVENTION

The present invention relates to a manual device to self apply a technique of dorsal acupressure, diathetic medicine and magnet therapy which are useful for the relief of certain kinds of body pain.

BACKGROUND OF THE INVENTION

For several decades interest in the application of the non-traditional treatment techniques for the relief of body pain and other organic irregularities has increased. An important area of these non-traditional techniques is called Diathetic Medicine, which is related to the constitutional tendency of the human body to suffer certain diseases.

Diathetic medicine includes two branches: acupuncture and catalytic medicine. Acupuncture consists of the physical stimulation of certain points of the skin, through needles, massages (or acupressure) or moxibustion. Moxibustion is the combustion of certain substances applied to certain points on the skin. The object of this local stimulation on the skin, according to the principles of acupuncture, is to manipulate the energy that circulates through certain meridians in the organism. According to this principle, several kinds of pain and organic dysfunctions are due to irregularities in the flux of energy due to congestions produced in certain nodes of the meridians.

Catalytic or diathetic medicine bases its treatment in the prescription of certain trace elements such as manganese, copper, cobalt, gold, silver, zinc, etc., whose catalytic presence causes important chemical reactions in the organism that modify the metabolism. The efficiency of this technique has motivated its study in the main occidental medical investigation centers.

A variety of devices and apparatus are known that allow the stimulation of the energetic points of the body, through the application of small electric discharges on certain points of the skin. Several mechanical and electromechanical apparatus have been developed that allow one to carry out massages on points on the skin. These mechanical and electromechanical apparatus, designed to practice point stimulation on the skin, do not allow comfortable access to certain parts of the body such as the back. The back has a large number of points that can be stimulated for the relief of frequent pain such as lumbago, headache, etc. These devices can be used by the masseur or the operator to work on the therapeutic actions on the patient. It is always better for the affected person or patient to stimulate the key points. In this manner he or she can locate with greater precision the points where the stimulus must be applied to obtain greater relief.

The use of magnets as an alternative treatment of the body has developed, based on the observation of the sensitivity of the human body to the geomagnetic field. The geomagnetic field is considered important to maintain many biological functions and systems. People who are not sufficiently exposed to the geomagnetic field such as workers in highrise buildings with steel superstructures can suffer backache, headache, insomnia, etc. Magnets have been applied to the body to relieve many of these problems.

A problem with self massage or acupressure originates when the subject must use strength and asymmetrical positions to reach appropriate points of stimulation. A method and apparatus to overcome these problems and which permits the application of all of these techniques of acupressure, catalytic medicine and magnet treatment is needed. A human thumb bone structure typically can only exert about 1–2 lbs. of pressure, while effective acupressure requires about 5 lbs. pressure.

SUMMARY OF THE INVENTION

The present invention includes a simple but efficient manual device for self stimulation by acupressure on points on the skin that are difficult to access, like the back, the back part of the muscles, bottom of feet, etc., without the subject having to be in inappropriate body positions. The invention permits completion of an acupressure technique of catalytic medicine, in the same way.

The present invention comprises a substantially "J"-shaped rigid frame having a first tip at one end for application of pressure to specific points of the user's body and a handle at the other end. The first tip is adapted to be placed on the back portions of the user while the frame is substantially transverse to the user's body. The handle is adapted to be grabbed by the user such that a pushing force imparted to the handle away from the user's body transmits pressure to the first tip. The tip may include a magnet with a layer of elements.

BRIEF DESCRIPTION OF THE DRAWINGS

To better understand the invention it will be described with reference to the drawings that show some of the examples of application, but the scope of the invention is not intended to be limited to these drawings which merely set forth examples.

FIG. 4 is an enlarged fragmentary, partial cross-sectional view of the tip used in the present invention.

FIG. 5 is an isometric perspective view of another embodiment of the device made in accordance with the present invention.

DETAILED DESCRIPTION OF THE INVENTION

Figure 1:
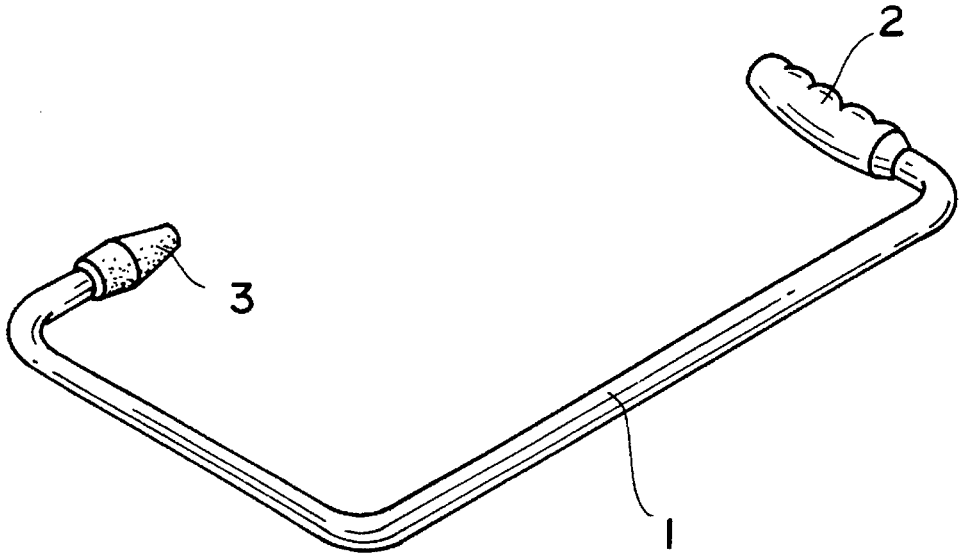
FIG. 1 is an isometric perspective view of a first embodiment of the invention.
Figure 2:
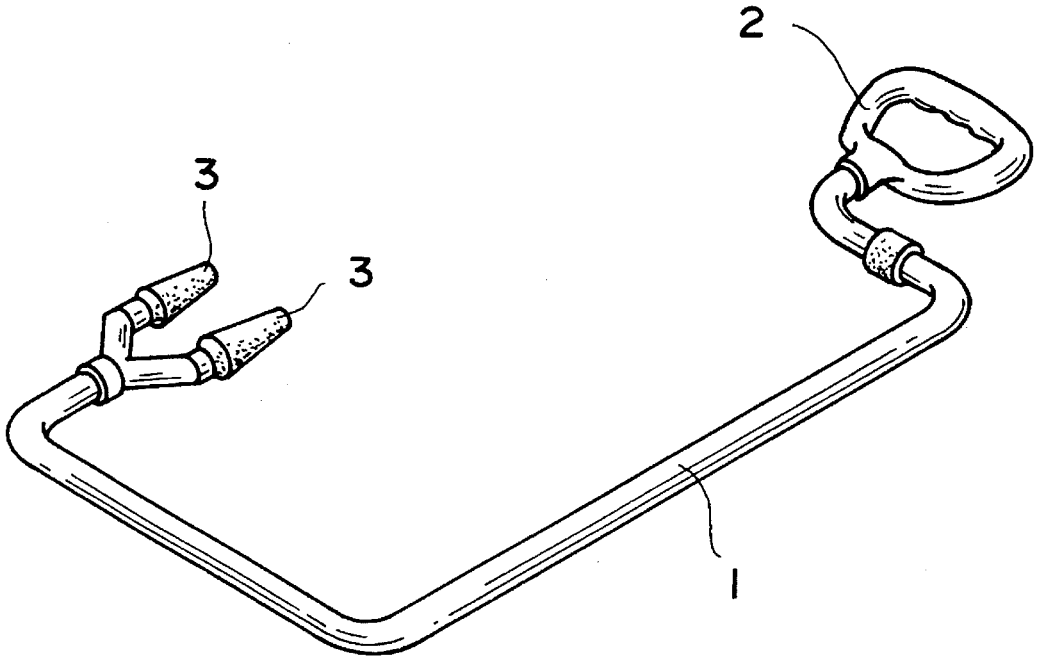
FIG. 2 is an isometric perspective view of a second embodiment of the invention.
Figure 3:
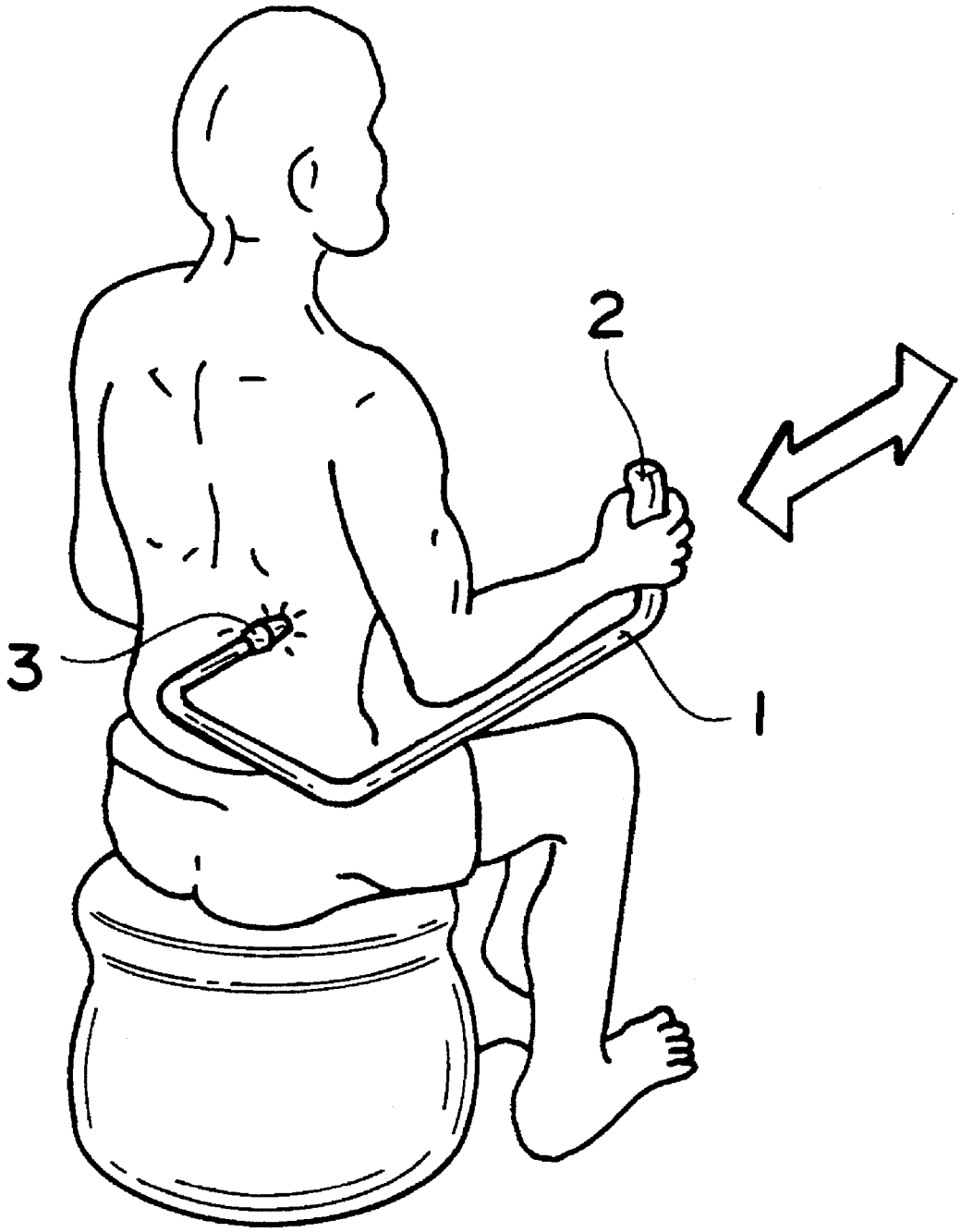
FIG. 3 is an isometric perspective view showing how to use the present invention.

As shown in FIGS. 1 to 3, a device R consists of a rigid or semi-rigid C- or J-shaped frame 1 of metal such as steel or aluminum plated with magnesium, manganese, cobalt, nickel, or zinc or another appropriate metal.

One of the extremes of frame 1 terminates in a handle 2 that is in the same level or plane of the frame. Alternatively, as shown in FIG. 3, a device T is provided with the handle 2 disposed transversely to the plane of frame 1. The transversely disposed handle 2 advantageously provides a normal and comfortable grip for the user and allows the user to exert relatively greater pushing force on the handle and hence on the pressure point at the back.

The other end of the frame 1 has a tip 3 that can be fixed or removable. As shown in FIG. 2, a device S is provided with two tips 3 at the end of frame 1. The application of the multiple tips 3 is recommended when stimulation in more than one point of the body is needed. The two tips are required to be positioned so that they contact points located symmetrically down the spine.

The selection of the material for the tip 3 is important when combining the benefits of acupressure with catalytic medicine. The material for the tip 3 can be rubber or plastic, but preferably metal, such as copper, magnesium, manganese, cobalt, zinc, nickel and others. Magnetic materials can also be used.

The tip 3 has a recess 4 that is adapted to receive a magnet 6 in an interference fit. The recess 4 is disposed at the apex of the tip 3, as best shown in FIG. 4. The recess 4 is slightly less than the width of the magnet 6 and deeper than the height of the magnet 6 such that the magnet 6 is securely received within recess 4 with the top surface 10 of the magnet 6 slightly below the outer edge 12 of the recess 4, as best shown in FIG. 4. This advantageously insures that the magnet 6 will not be inadvertently pulled from the recess 4 as when it accidentally contacts a metallic structure, since the magnet 6 has a relatively strong magnetic field.

The tip 3 includes a conical portion terminating into a rounded apex where the recess 4 is disposed. The shape advantageously concentrates the applied pressure at the narrowed apex portion.

The magnet 6 has a top layer or plating containing elements, such as lithium, potassium, calcium, sodium, magnesium, aluminum, zinc, chromium, ferrous iron, cadmium, cobalt, nickel, tin, lead, ferric iron, copper, mercury, silver, gold and manganese. Preferably, the plating 14 comprises elements of manganese, manganese-copper, manganese-cobalt, copper-gold-silver, zinc-copper, or zinc-nickel-cobalt. The magnet 6 preferably provides a magnetic field in the range of 800 to 3,000 gauss.

The importance of these trace elements are discussed in Yves Requena, M.D., "Terrain and Pathology in Acupuncture," Volume 1, Paradigm Publications, Brookline, Mass., 1986. See also Matsumoto et. al., "*Extraordinary Vessels*," Paradigm Publication, Brookline, Mass., 1986.

Another embodiment of a device U is disclosed in FIG. 5. The device U has a handle 16 that is disposed transversely to the plane formed by the frame 1. The handle 16 also includes the tip 3 with the magnet insert 6, as best shown in FIG. 4. The tip 3 associated with the handle 16 is advantageously used to press on pressure points located on the head and front of the body. The handle 16 is advantageously disposed such that the user can direct the tip 3 associated with the handle 16 to the pressure points in front of the patient's body or head without the frame 1 interfering with the rest of the body.

The use of the device of the present invention is simple. As shown in FIG. 3, the patient can self apply the acupressure instead of having acupuncture applied. Acupressure, which is the application of pressure to the same points to which acupuncture is applied, accomplishes the same function as acupuncture. For example, the device can be used to treat backache. In this case one takes the device by the handle 2 so the frame 1 is in a position transverse to the length of the body. The tip 3 will then be positionable so as to press the point of the body that the patient wishes to stimulate. In this way the patient-operator should make short movements with the arm so that the tip 3 will press the desired points.

The frame 1 is advantageously shaped to provide access for the user to reach acupressure points on the back of the body without the frame interfering with the user's body. The frame shape also advantageously allows the user to exert relatively greater pushing force on the handle 2 that is then transmitted to the tip 3, as best shown in FIG. 3. The frame 1 may be formed from a pipe material with a leg portion 18, a base portion 20 bent perpendicularly to the leg portion 18, and hook portion 22 bent perpendicularly to the base portion 20, as best shown in FIG. 1. The frame 1 preferably lies on a single plane.

Certain variants of the device are obvious. For example, the handle 2 can be connected to the frame 1 as a movable part to change its angular position relative to the frame 1 or as a removable part to interchange with other parts, as best shown in FIG. 2. The handle 2 may also be "D"-shaped, as best shown in FIG. 2. The frame 1 may be formed in different shapes for application to different parts of the body, depending on the area of the body that the patient wishes to stimulate.

The frame 1 may also have extended parts which allow even better access to different areas of the body. Extension systems are already known from other devices, such as the tripods, certain orthopaedic apparatus, certain furniture, etc.

Accordingly, while this invention has been described with reference to illustrative embodiments, this description is not intended to be construed in a limiting sense. Various other embodiments of the invention, as well as other embodiments of the invention, will be apparent to persons skilled in the art upon reference to this description. It is therefore contemplated that the appended claims will cover any such modifications or embodiments as within the true scope of the invention.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and in any case be applied to the central features hereinbefore set forth, and fall within the scope of the invention or limits of the claims appended hereto.

I claim:

1. A manual device for self-application of acupressure by a user, comprising:

a) a substantially "J"-shaped rigid frame having a first tip at one end for application of pressure to specific points of the user's body and a handle at the other end;

b) said first tip being adapted to be placed on the back portions of the user while said frame is substantially transverse to the user's body; and c) said handle being adapted to be grabbed by the user such that a pushing force on said handle away from the user's body imparts pressure to said first tip; and d) said first tip includes a magnet to be disposed adjacent to the user's body when said tip is placed on the body.

2. A manual device as in claim 1, wherein:

a) said first tip includes a recess and said magnet is disposed therein.

3. A manual device as in claim 1, wherein:

a) said magnet includes an outer surface disposed toward the user's body and having a layer comprising at least an element selected from the group comprising lithium, potassium, calcium, sodium, magnesium, aluminum, zinc, chromium, ferrous iron, cadmium, cobalt, nickel, tin, lead, ferric iron, copper, mercury, silver, gold and manganese.

4. A manual device as in claim 1, wherein:

a) said first tip is made of rubber material.

5. A manual device as in claim 2, wherein:

a) said handle is disposed transversely to said frame.

6. A manual device as in claim 1, wherein:

a) said handle includes a tip portion for applying pressure to the user's front body portion.

7. A manual device as in claim 6 wherein:

a) said handle tip portion includes a magnet.

8. A manual device as in claim 1, and further comprising:

a) a second tip secured to said frame and disposed adjacent to said first tip for simultaneous application of pressure at two locations at the back of the user's body.

9. A manual device for self-application of acupressure by a user, comprising:

a) a substantially "J"-shaped rigid frame having a first tip at one end for application of pressure to specific points of the user's body and a handle at the other end;

b) said first tip being adapted to be placed on the back portions of the user while said frame is substantially transverse to the user's body;

c) said handle being disposed transversely to said frame to permit the user to grab said handle such that a pushing force away from the user's body is imparted to said handle, thereby transmitting the force to said first tip; and d) a magnet operably associated with said tip such that said magnet is disposed adjacent the user's body when said tip is placed on the user's body.

10. A manual device as in claim 9, wherein:

a) said magnet includes a surface disposed toward the user's body and includes a layer comprising at least an element.

11. A manual device as in claim 9, and further comprising:

a) a second tip secured to said frame and disposed adjacent to said first tip for simultaneous application of pressure at two locations at the back of the user's body.

12. A manual device as in claim 11, wherein:

a) said first and second tips are disposed in a "Y"-shaped configuration.

13. A manual device as in claim 9, wherein:

a) said magnet has a field strength in the range of 800–3000 gauss.

14. A manual device as in claim 10, wherein:

a) said elements are selected from the group comprising manganese, manganese-copper, manganese-cobalt, copper-gold-silver, zinc-copper, and zinc-nickel-cobalt.

15. A manual device as in claim 9, wherein:

a) said handle is "D"-shaped.

16. A manual device as in claim 9, wherein:

a) said handle is selectively positionable with respect to said frame.

17. A manual device as in claim 9, wherein:

a) said tip includes a conical portion.

* * * * *